United States Patent [19]

Iwasaki et al.

[11] 4,107,375

[45] Aug. 15, 1978

[54] BULKY ASPHALT-IMPREGNATED SHEET HAVING DIFFERENT PROPERTIES ON BOTH SURFACES

[75] Inventors: Hajime Iwasaki; Yasuo Tomita, both of Tokyo, Japan

[73] Assignee: Mitsuboshi Sangyo Co., Ltd., Japan

[21] Appl. No.: 683,214

[22] Filed: May 4, 1976

[30] Foreign Application Priority Data

Dec. 30, 1975 [JP] Japan ..... 51-156331

[51] Int. Cl.[2] ..... B32B 11/02

[52] U.S. Cl. ..... 428/291; 427/209; 427/358; 427/434 R; 427/442; 427/443; 428/489

[58] Field of Search ..... 427/434 R, 442, 443, 427/356; 428/298, 291, 301, 489

[56] References Cited

U.S. PATENT DOCUMENTS

| | | | |
|---|---|---|---|
| 1,587,652 | 6/1926 | Johnston | 427/442 |
| 2,343,600 | 3/1944 | Weimann | 427/443 |

*Primary Examiner*—James J. Bell

*Attorney, Agent, or Firm*—Wenderoth, Lind & Ponack

[57] ABSTRACT

A bulky asphalt-impregnated sheet comprising a base material of a bulky sheet of non-woven fabric which is uniformly and completely saturated with asphalt on the surface layers of the front and rear sides of said base material, said surface layers having of different properties from each other. A method and a system for manufacturing such bulky sheet comprises preparing the base material of non-woven fabric uniformly and completely saturated with asphalt, scraping off the asphalt from the surface of said base material and then applying a material of a different property onto the scraped surface.

6 Claims, 1 Drawing Figure

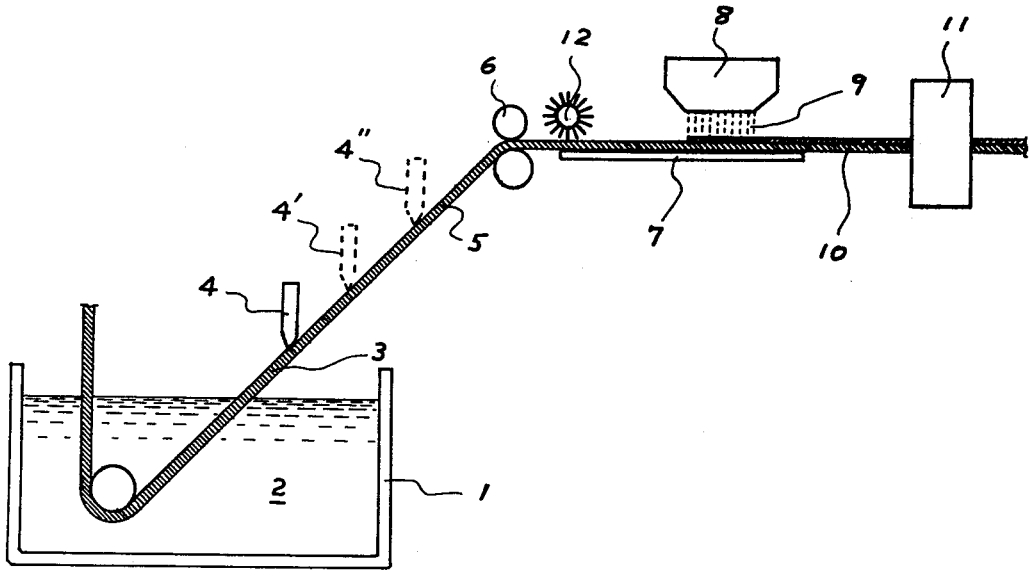
8
12
11
6
9
4''
4'
5
7
10
4
3
2
1

BULKY ASPHALT-IMPREGNATED SHEET HAVING DIFFERENT PROPERTIES ON BOTH SURFACES

BACKGROUND OF THE INVENTION

The present invention relates to a bulky asphalt-impregnated sheet having different properties on both surfaces thereof and a method and a system for manufacturing such bulky asphalt-impregnated sheet.

Recently, we have developed an asphalt roofing which comprises a base material of a bulky sheet of non-woven fabric made of filaments intertwisted with each other and an asphalt with which said base material is uniformly and completely saturated and which also covers both sides of said base material. This asphalt roofing can be produced by feeding said bulky sheet along a vertical path into a bath of molten asphalt, thereby permitting the air contained within the bulky sheet to successively escape vertically through the bulky sheet itself into the atmosphere while permitting the bulky sheet to be uniformly and completely saturated with said molten asphalt, and then withdrawing said sheet into the atmosphere and drying the same. The present invention utilizes an intermediate product of such asphalt roofing, namely, a bulky sheet which is impregnated with and covered, on its both sides, by asphalt which is still in a fluid or semi-solidified state, to produce a novel product, that is a bulky asphalt-impregnated sheet having materials of different properties and different functions on both sides thereof. This novel product can be produced by dipping a bulky sheet of non-woven fabric into a bath of molten asphalt to saturate said bulky sheet with the asphalt, withdrawing said sheet upward from said bath of molten asphalt, scraping off the asphalt on one surface, either front or rear surface, of said sheet while the sheet is being pulled upward and the asphalt is held in a fluidized or semi-solidified state, and then supplying and firmly adhering a material of different property onto said sheet.

The conventional asphalt roofing is produced by preparing a felt-like base material mixed with paper or asbesto fibers or a base material made of non-woven fabric of synthetic fibers, impregnating said base material with molten asphalt and then forming asphalt coating layers on both sides of said base material. In case of the felt-like base material made of paper or asbesto fibers, the base material has a thickness of about 1.4 mm, including base material having a thickness of about 0.6 mm and a surface asphalt layer having a thickness of about 0.4 mm. Therefore, the scraping off of the thin surface layer of the asphalt under fluidized or semi-solidified state will necessarily result in breaking or tearing of the base material made of the fragile fibers.

Also, in the case of a base material made of non-woven fabric, the base material has a thickness below 2 mm and the surface asphalt layer has a thickness to below 0.5 mm. The base material has a sufficiently high strength to allow the surface asphalt layer to be scraped off, but the exposed surface is hard and smooth so that the adhering ability is decreased. Furthermore, since the base material has a small thickness, it tends to soften and deform if the material of different property is supplied at high temperature. Accordingly, a roofing having materials of different properties on both side surfaces cannot be obtained, except a combined structure including two sheets adhered together.

STATEMENT OF THE INVENTION

The present invention uses, as its base material, a bulky sheet of a non-woven fabric having substantial flexibility and restoring ability which is usually produced by the needle-punch process. The base material is dipped in the bath of molten asphalt contained in the tank and withdrawn upward from the tank to form an asphalt-impregnated sheet and then the asphalt on the front or rear surface of said sheet under fluidized or semi-solidified state is scraped off by means of a scraper blade so as to expose the fibrous surface of said sheet. Thus, the present invention utilizes the adhesive property of the asphalt remaining between the fibers and the chemical and physical retaining properties of the fibers to firmly connect the material of different property supplied onto the sheet, thereby providing an integral asphalt-impregnated sheet having materials of different properties on both sides.

More particularly, a bulky sheet of non-woven fabric having 4-8 mm thickness is used as the base material, which is passed through a bath of molten asphalt (softening point 90° C penetration 30-40, elongation 3 at 25° C) contained in a dipping tank and then withdrawn upward therefrom, to form an asphalt-impregnated sheet having a molten asphalt layer of 0.5-1.0 mm thickness retained on each side thereof. On the way of the upward movement of said sheet, the molten asphalt layer gradually changes from the fluid state at substantially the same temperature as the molten asphalt in the dipping tank, through the semi-molten state to the semi-solidified state near the driving roll, during which the asphalt on the front or rear surface of the sheet is scraped off by means of a blade or the like, so as to leave a very small amount of the asphalt between the fibers. Then the sheet is fed through the driving roll onto a supporting plate, where a catalytic blowing asphalt (softening point 105° C, penetration 20-30, elongation 2 at 25° C) is supplied onto the fibrous surface of the sheet to be firmly adhered thereto, thus producing an asphalt-impregnated sheet having materials of different properties on both surfaces thereof. This sheet may be subjected to an after-treatment, if desired, and continuously wound onto a roll.

If desired or required in view of the property or function of the material supplied, a retreatment device consisting of needle-like or comb-like members may be arranged immediately after the driving roll, to more completely remove very small amounts of the asphalt remaining between the fibers, thereby exposing only fibers on the fibrous surface. For example, rubberized asphalt (containing 7% of SBR, softening point 110° C, penetration 10-20, elongation 2 at 25° C) is spread or poured onto the fibrous surface, to produce an asphalt-impregnated sheet having different properties on both sides. The sheet thus produced may be subjected to an after-treatment and then wound up on a roll.

BRIEF DESCRIPTION OF THE DRAWING

The single drawing illustrates an asphalt roofing manufacturing system according to one embodiment of the present invention.

PREFERRED EMBODIMENTS OF THE INVENTION

Now the invention will be explained with reference to the FIGURE which illustrates the asphalt roofing manufacturing system according to one embodiment of the present invention. In the drawing, 1 is a dipping tank, 2 is a molten asphalt, 3 is an asphalt-impregnated bulky sheet of non-woven fabric, 4, 4' or 4'' is a scraper blade, 5 is an asphalt-impregnated sheet with its asphalt layer on one surface being scraped off, 6 is a driving roll, 7 is a supporting plate, 8 is a hopper, 9 is a material of different property, 10 is an asphalt-impregnated sheet having materials of different properties on both side surfaces, 11 is an after-treatment device and 12 is a retreatment device.

The bulky sheet of non-woven fabric 3 is passed through the molten asphalt 2 contained in the dipping tank and withdrawn upward therefrom by means of the driving roll 6.

The asphalt on one surface of said sheet is scraped off by means of the scraper blade 4, 4' or 4'' to form the asphalt-impregnated and scraped sheet 5, which is fed by the driving roll onto the supporting plate 7, where the material 9 of different property is supplied from the hopper 8 onto the exposed fibrous surface of said asphalt-impregnated and scraped sheet, thereby producing the asphalt-impregnated sheet 10 having surfaces of different properties on both sides thereof. In the after-treatment device the sheet is heated or cooled and then continuously wound up on a roll (not shown).

The retreatment device 12 is arranged to further completely remove small amounts of asphalt remaining between the fibers of the fibrous surface in order to further expose the fibrous surface, when such is required in view of the property of the material supplied thereto, but this retreatment device is not always employed. Also, the after-treatment device may be omitted and the sheet may be directly wound onto the roll. If it is desired to scrape off the asphalt on the rear side of said sheet, the material of different property may be supplied from below by means of projecting or spraying device onto the sheet after passing the driving roll, but it is preferable to firstly turning the sheet upside down to position the fibrous surface upside and then supplying the material in the same manner.

The scraper blade may be located at different positions as shown in the drawing, in order to obtain the desired state of the fibrous surface, depending on whether said blade is pressed against the sheet strongly or weakly and what material is used as a material for forming the surface of different property. That is, when the scraper blade is located near the molten asphalt level and if it is strongly pressed against the sheet, the large amount of asphalt is scraped off so that large amounts of fibers are exposed and a very small amount of asphalt is left on the fibrous surface, while if it is weakly pressed against the sheet, less asphalt is removed so that less fibers are exposed and more asphalt is left on the fibrous surface. When the scraper blade is located near the driving roll, substantially the same relation exists but in this case the asphalt has less fluidity so that it is hard to scrape off a large amount of the asphalt. When the scraper blade is located at an intermediate position, the relation in the midst of those described above will exist.

When the asphalt-impregnated and scraped sheet fed onto the supporting plate has a fibrous surface which comprises a large amount of exposed fibers and a small amount of asphalt remaining between the fibers, various products can be produced as follows:

(A) By supplying (pouring) a rubberized asphalt onto the scraped fibrous surface, an asphalt-impregnated sheet product is obtained which has superior extensibility and low temperature resistance, owing to the property of the rubberized asphalt, and which is suitable for use as a waterproof material.

(B) By applying a sheet such as a rubberized asphalt sheet onto the scraped fibrous surface while heating and melting said sheet from the rear side thereof and causing said sheet to be firmly adhered to said scraped fibrous surface, an asphalt-impregnated sheet having a rubberized asphalt layer of uniform thickness suitable for use as a construction material or waterproof material is obtained.

(C) By supplying a tacky composition added with petroleum resin or the like, a product is obtained which is useful as a base for polyvinyl resin tile, asphalt tile, pottery tile or the like and suitable for use as a flooring material.

(D) By supplying a molten asphalt composition similar to the material in (C) and then adhering a thermoplastic resinous sheet, such as soft polyvinyl-chloride sheet thereon, a product is obtained which is superior in wear resistant property and useful as a flooring material.

(E) By supplying an asphalt modified by a thermosetting resinous material such as epoxy resin, a product is obtained which has a hard surface and good chemical resistance and which is suitable for use as a flooring material.

When the asphalt-impregnated and scraped sheet fed onto the supporting plate has a fibrous surface which comprises a small amount of exposed fibers and a large amount of asphalt remaining between the fibers, various products can be produced as follows:

(A) By applying wool-like material (staple fibers wool, synthetic fiber wool, glass wool, rock wool, asbestos wool), a product is obtained which is useful as an ornamental material for ceiling, wall or like material or a heat-insulating and sound arresting material.

(B) By applying such fibrous material (textile material, net material), an ornamental product is obtained which is useful as a wall or ceiling surface material.

When the asphalt-impregnated and scraped sheet fed onto the supporting plate has a fibrous surface in which the asphalt remaining between the fibers is further removed to expose more amount of fibers by means of needle-like or comb-like retreatment device immediately after the sheet has reached on the supporting plate, the following products can be produced:

(A) By supplying foamable urethane resin, a product is obtained which has heat-insulating and sound-absorbing properties, so that it is useful as a flooring material and wall material.

(B) By supplying a cement mortar which is mixed with asphalt emulsion, rubberized asphalt emulsion, synthetic resin emulsion, synthetic rubber latex, or the like a product is obtained which is effectively used as a flooring material and wall material.

It will be understood that the asphalt-impregnated sheet as described above can be subjected to further processing, according to requirements, for example, material or product having different property or configuration from those described above can be applied to the front or rear surface of said sheet.

Thus, the present invention provides an asphalt-impregnated sheet having materials of different properties on the both surfaces thereof which can be easily manufactured by the method and the system according to the present invention. This sheet comprises a base layer which is fully impregnated with asphalt and various kinds of surface layers firmly fixed to said base layer, so that this sheet can be used not only as an interior construction material for ceiling, wall or floor but also as an exterior waterproofing material which can easily form a waterproof structure in a single process. Furthermore, it has been found that this sheet can be used for earth working. Thus, the sheet according to the present invention can be widely used in the various fields including civil engineering and construction fields and it will contribute to the development of industry in such fields and, in its turn, have great influences on the happiness, prosperity and welfare of mankind.

EXAMPLE 1

A non-woven fabric of polypropylene (15 denier, 450 g/m$^2$, thickness 4.5 mm) was dipped in a bath of molten blowing asphalt (softening point 90° C, penetration 35, elongation 2 at 25° C), and an asphalt-impregnated sheet having thickness of about 5.5 mm was produced. On the way of upward movement of the sheet, the asphalt on one surface of the sheet was strongly scraped off by the scraper blade which was located near the level of the bath of molten asphalt and thus an asphalt-impregnated and scraped sheet of about 5 mm having one fibrous surface with little asphalt remaining between the fibers thereof was obtained. The sheet thus obtained was fed onto the supporting plate, where foamable urethane resin which had been previously prepared was supplied from the hopper onto the fibrous surface of said sheet and allowed to foam and set thereon at ordinary temperature to form a foam layer of about 15 mm thickness, which was subjected to a surface treatment, whereby an asphalt-impregnated sheet having a surface layer of hard urethane foam of about 10 mm thickness firmly attached to one side thereof was obtained. The urethane resin is firmly and closely connected to the fibrous surface of the sheet and completely set thereon, and this layer has a superior thermal insulating quality. This asphalt sheet allows one to easily produce a waterproof structure which has satisfactory waterproofing and heat-insulating properties, by applying suitable after-treatment thereto, for example forming a vinyl-chloride coating on the foam layer. Also, an asphalt-impregnated sheet having various kinds of surface, as desired, can be obtained by adhering various materials onto the foam layer.

EXAMPLE 2

A non-woven fabric of polypropylene (15 denier, 400 g/m$^2$, thickness 4 mm) was dipped in a dipping tank in the same manner as in Example 1, to produce an asphalt-impregnated sheet of about 5 mm thickness. Then, the asphalt on one surface of said sheet was scraped off by a scraper blade which was located midway between the molten asphalt level and the driving roll and held at the temperature of 140° C, to produce an asphalt-impregnated and scraped sheet of about 4.5 mm thickness having one fibrous surface with little asphalt remaining between the fibers thereof. The sheet was fed onto the supporting plate, where a rubberized asphalt sheet (containing 15% of chloroprene) of 1.5 mm thickness was supplied onto the fibrous surface of the sheet while being heated to 170° C by an infrared lamp or the like from rear side thereof to soften and melt said sheet, and immediately pressed and adhered to the asphalt sheet. The combined sheet was treated and cooled by the after-treatment device, and thus an asphalt-impregnated sheet having different surface properties on the both sides was obtained and continuously wound up onto the roll. The sheet thus obtained has one surface made of rubberized asphalt which has large extensibility, flexibility and restoration ability at high temperature, and therefore this sheet is particularly useful as a waterproofing material for bridges, structures and the like which are subject to large vibration and makes it possible to easily produce a waterproof construction in a single process by using materials having high durability.

EXAMPLE 3

An asphalt sheet of about 4.5 mm thickness having its asphalt on one surface scraped off was produced in the same manner as in Example 2. On the way from the driving roll to the supporting plate, the asphalt remaining in the fibrous surface was further scraped off by a retreatment device including needle-like projections. A cement mortar added with 15% of rubberized asphalt emulsion was applied onto the scraped fibrous surface and wiped by a doctor blade, to produce an asphalt-impregnated sheet having a cement mortar layer on one side thereof. In this case, the sheet was cut to a suitable length before reaching the following feed roll, thereby providing final products having predetermined size.

EXAMPLE 4

An asphalt sheet of about 3 mm thickness was prepared in the same manner as in Example 1 from a non-woven fabric of polypropylene (8 denier, 200 g/m$^2$, thickness 2 mm). The asphalt was weakly scraped off by the scraper blade which was located near the driving roll, to produce a sheet of about 2.5 mm thickness having very small amount of asphalt remaining between the fibers of the fibrous surface. This sheet was fed onto the supporting plate, where small amount of catalytic blowing asphalt (softening point 95° C, penetration 25) in thermally molten state was supplied from the hopper onto the sheet and pattern and color were applied thereto by embossing treatment. A glass network of 0.8 mm thickness was applied under pressure onto the sheet, and then the sheet was cut to a suitable length before reaching the following feed roll, thereby providing desired wall board, ornamental board or the like.

EXAMPLE 5

An asphalt sheet having catalytic blowing asphalt supplied thereto as in Example 4 was prepared. Synthetic fiber wool was spread upon the sheet, which was pressed by means of a pressing roll to about 5 mm thickness and cooled, to produce an asphalt-impregnated sheet, This sheet was further subjected to a surface treatment, thereby producing ceiling or wall boards having heat-insulating and sound arresting properties.

We claim:

1. A method of manufacturing a bulky asphalt-impregnated sheet having asphalt on one side and a material different from the asphalt and which has different physical properties therefrom on the other side of the sheet which comprises continuously feeding a bulky sheet of a non-woven fabric into a bath of molten asphalt so as to completely saturate said bulky sheet with the molten asphalt, withdrawing said bulky sheet completely saturated with and coated on both sides thereof by the molten asphalt into the atmosphere from said bath, scraping off the asphalt, when it is in a fluidized or semi-solidified state, from one side of said sheet to expose the fibrous surface of one side of said sheet having very little asphalt remaining on the surface thereof so as to form a rough surface and then applying a material different from that of said asphalt onto the exposed fibrous surface so as to firmly adhere said material different from that of the asphalt onto the rough face of the exposed fibrous surface taking advantage of the adhesive property of the asphalt between the fibers of the exposed fibrous surface.

2. A method according to claim 1, in which said material different from that of the asphalt is applied onto the exposed fibrous surface while heat is applied thereto.

3. A method according to claim 1, wherein a low-temperature waterproof rubberized asphalt is applied to the scraped surface of the sheet and wherein the other side is blown asphalt.

4. A method according to claim 1, wherein a polyvinyl chloride resin is applied to the scraped surface of the sheet.

5. A method according to claim 1, wherein a foamable urethane resin is applied to the scraped surface of the sheet.

6. A bulky asphalt impregnated sheet produced according to the method of claim 1.

* * * * *